US006941925B2

(12) United States Patent
Yamada

(10) Patent No.: US 6,941,925 B2
(45) Date of Patent: Sep. 13, 2005

(54) FUEL SUPPLY CONTROL SYSTEM FOR ENGINE

(75) Inventor: Yoshikazu Yamada, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/892,498

(22) Filed: Jul. 16, 2004

(65) Prior Publication Data

US 2005/0028781 A1 Feb. 10, 2005

(30) Foreign Application Priority Data

Aug. 4, 2003 (JP) ..... 2003-286288

(51) Int. Cl.[7] ..... F02B 77/00

(52) U.S. Cl. ..... 123/198 D; 123/196 R; 261/35; 261/69.2; 261/DIG. 68

(58) Field of Search ..... 123/198 D, 196 R, 123/196 S, 517; 261/35, 69.2, DIG. 68

(56) References Cited

U.S. PATENT DOCUMENTS 4,690,108 A * 9/1987 Debevec ..... 123/73 AD
5,584,278 A 12/1996 Satoh et al.
5,743,240 A 4/1998 Zerrer et al.
5,924,400 A * 7/1999 Kobayashi ..... 123/196 R
6,135,429 A 10/2000 Woody

FOREIGN PATENT DOCUMENTS

FR 2 264 190 10/1975

* cited by examiner

*Primary Examiner*—Weilun Lo
(74) *Attorney, Agent, or Firm*—Arent Fox, PLLC.

(57) ABSTRACT

In a fuel supply control system for an engine in which a valve housing is provided with a negative pressure working chamber, and a negative pressure responsive-type control valve operable to be opened and closed in response to generation and extinction of a negative pressure in the negative pressure working chamber, the control valve being incorporated into a fuel passage between a fuel tank and a carburetor, the negative pressure working chamber being in communication with a negative pressure generating section in the engine through a negative pressure conduit, an oil flow-out preventing device is provided in a connecting portion for connecting the negative pressure generating section and the negative pressure conduit to each other. The oil flow-out preventing device is adapted to cut off the communication between the negative pressure generating section and the negative pressure conduit by a lubricating oil received from the negative pressure generating section, when the engine is inclined at a given angle or more. Thus, in an operational attitude of the engine, the transmission of the negative pressure from the negative pressure generating section to the negative pressure conduit is not obstructed, and even when the engine is inclined at the given angle or more in an operation-stopped state of the engine, the lubricating oil in the engine can be prevented from flowing out toward the negative pressure conduit.

2 Claims, 15 Drawing Sheets

OPERATION OF ENGINE STOPPED

PRESSURE IN FUEL TANK RAISED

PRESSURE IN FUEL TANK REDUCED

DURING OPERATION OF ENGINE

FUEL SUPPLY CONTROL SYSTEM FOR ENGINE

BACKGROUND OF THE INVENTION

1. Field of the Invention

The present invention relates to an improvement in a fuel supply control system for an engine, comprising a diaphragm attached to a valve housing to define a negative pressure working chamber, a control valve which is connected to the diaphragm and which is operable to be opened and closed by advancing and returning of the diaphragm due to generation and extinction of a negative pressure in the negative pressure working chamber, the control valve being incorporated into a fuel passage system which provides communication between a portion of a fuel tank below a fuel oil surface and a fuel supply section in the engine, the negative pressure working chamber being in communication with a negative pressure generating section in the engine through a negative pressure conduit.

2. Description of the Related Art

Such a fuel supply control system for an engine is already known, as disclosed in, for example, Japanese Utility Model Application Laid-open No. 2-27145.

Especially, a general-purpose engine may be largely inclined or overturned during transportation or storage thereof. In such a case, an engine provided with the conventional fuel supply control system has a possibility that a lubricating oil in the engine may flow out of the negative pressure generating section toward the negative pressure conduit.

SUMMARY OF THE INVENTION

Accordingly, it is an object of the present invention to provide a fuel supply control system for an engine, wherein the transmission of a negative pressure from a negative pressure generating section to a negative pressure conduit is not obstructed in an operational attitude of the engine, and when the engine is inclined at a given angle or more in an operation-stopped state, a lubricating oil in the engine is prevented from flowing out of the engine toward a negative pressure conduit.

To achieve the above object, according to a first feature of the present invention, there is provided a fuel supply control system for an engine, comprising a diaphragm attached to a valve housing to define a negative pressure working chamber, a control valve which is connected to the diaphragm and which is operable to be opened and closed by advancing and returning of the diaphragm due to generation and extinction of a negative pressure in the negative pressure working chamber, the control valve being incorporated into a fuel passage system which provides communication between a portion of a fuel tank below a fuel oil surface and a fuel supply section in the engine, the negative pressure working chamber being in communication with a negative pressure generating section in the engine through a negative pressure conduit, wherein an oil flow-out preventing means is provided in a connecting portion for connecting the negative pressure generating section and the negative pressure conduit to each other, the oil flow-out preventing means being adapted to provide communication between the negative pressure generating section and the negative pressure conduit in an operational attitude of the engine, but to cut off the communication between the negative pressure generating section and the negative pressure conduit by a lubricating oil received from the negative pressure generating section, when the engine is inclined at a given angle or more.

With the first feature, the oil flow-out preventing means permits the negative pressure generating section and the negative pressure conduit to communicate with each other in the operational attitude of the engine. Therefore, during operation of the engine, a negative pressure generated in the negative pressure generating section is transmitted through the negative pressure conduit to the negative pressure working chamber, whereby the control valve can be opened to conduct the supply of the fuel from the fuel tank to the fuel supply section.

When the engine is inclined at the given angle or more during transportation or storage of the engine, the oil flow-out preventing means cuts off the communication between the negative pressure generating section and the negative pressure conduit by the lubricating oil received from the negative pressure generating section. Therefore, air cannot be moved in the negative pressure conduit leading to the negative pressure working chamber which is in a tightly closed state and hence, the flow-out of the oil to the negative pressure conduit can be prevented.

According to a second feature of the present invention, in addition to the first feature, the oil flow-out preventing means comprises an inner tube which is disposed at a central portion of the connecting tube for connecting the negative pressure generating section and the negative pressure conduit to each other and which is connected to the negative pressure conduit, and an outer tube which has an end wall covering an opening at a tip end of the inner tube and which is disposed concentrically between the inner tube and the connecting tube; an outer ventilation clearance is defined between opposed peripheral surfaces of the connecting tube and the outer tube to communicate with the negative pressure generating section; an inner ventilation clearance is defined between opposed peripheral surfaces of the outer tube and the inner tube to provide communication between the outer ventilation clearance and the inner tube on a side opposite from the end wall of the outer tube; and the connecting tube, the inner tube and the outer tube are disposed substantially horizontally in the operational attitude of the engine.

With the second feature, the outer ventilation clearance and the inner ventilation clearance in the oil flow-out preventing means permit the negative pressure generating section and the negative pressure conduit to communicate with each other in the operational attitude of the engine, and thus, during operation of the engine, a negative pressure generated in the negative pressure generating section can be reliably transmitted through the negative pressure conduit to the negative pressure working chamber. Moreover, each of the outer ventilation clearance and the inner ventilation clearance is cylindrical and hence, even if a small amount of the mist of the lubricating oil in the engine enters the outer ventilation clearance and the inner ventilation clearance, these clearances cannot be occluded by the mist.

When the engine is inclined at the given angle or more during transportation or storage of the engine, the lubricating oil received from the negative pressure generating section into the oil flow-out preventing means blocks the communication between the outer ventilation clearance and the inner ventilation clearance and hence, air cannot be moved in the negative pressure conduit leading to the negative pressure working chamber which is in a tightly closed state, so that the flow-out of the oil into the negative conduit can be prevented.

Moreover, the oil flow-out preventing means comprising the inner tube and the outer tube can be produced in a simple structure and at a low cost.

The negative pressure generating section and the fuel supply section correspond to a crank chamber 1*a* and a carburetor C in each of embodiments which will be described hereinafter; the diaphragm corresponds to a second diaphragm 42; the control valve corresponds to a second control valve; and the negative pressure working chamber corresponds to a second negative pressure working chamber 45.

The above and other objects, features and advantages of the invention will become apparent from the following description of the preferred embodiments taken in conjunction with the accompanying drawings.

DESCRIPTION OF THE PREFERRED EMBODIMENTS

The present invention will now be described by way of preferred embodiments with reference to the accompanying drawings.

Figure 1:
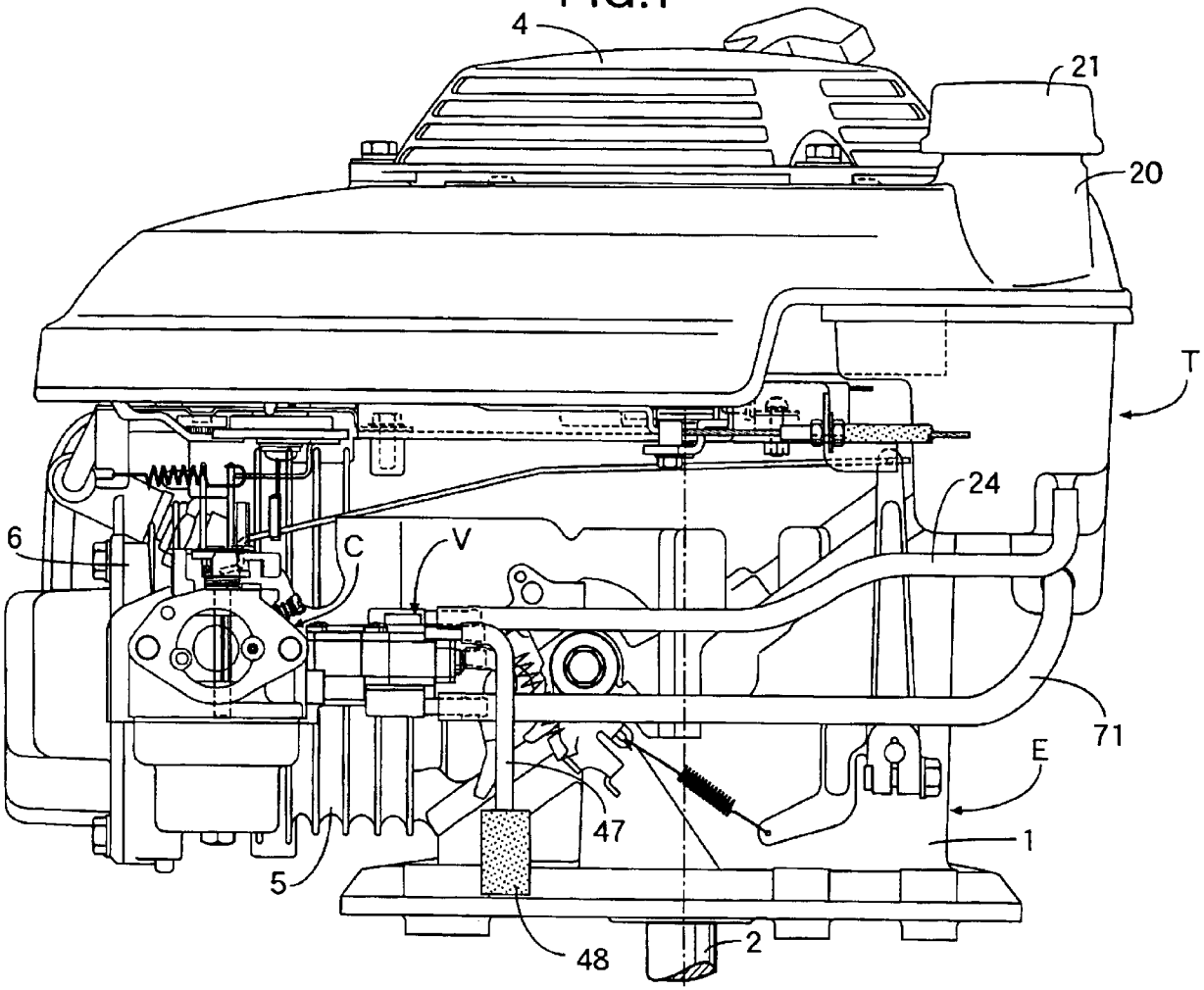
FIG. 1 is a side view of a vertical-type engine provided with a fuel tank according to a first embodiment of the present invention.
Figure 2:
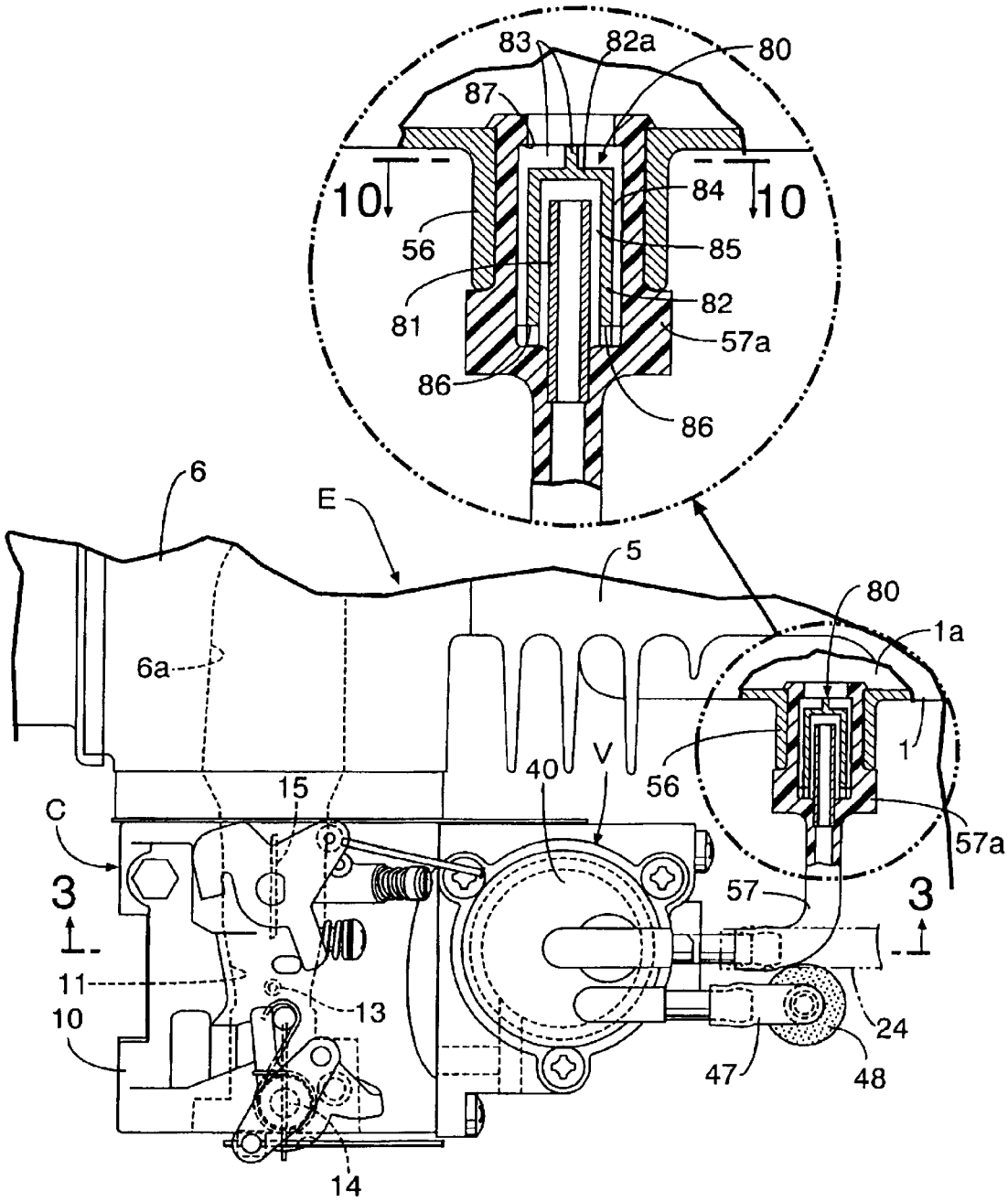
FIG. 2 is a plan view of portions around a carburetor in FIG. 1.

A first embodiment of the present invention shown in FIGS. 1 to 11 will be described first. In FIGS. 1 and 2, reference character E denotes a general-purpose engine of a 4-cycle vertical type. A crankshaft 2 supported in a crankcase 1 of the engine E is disposed vertically with its output end protruding downward below the crankcase 1. A fuel tank T and a recoil starter 4 are mounted to an upper portion of the crankcase 1.

A cylinder block 5 having a cylinder axis disposed horizontally is connected to one side of the crankcase 1, and a carburetor C is mounted to one side of a cylinder head 6 coupled to a tip end of the cylinder block 5.

Figure 3:
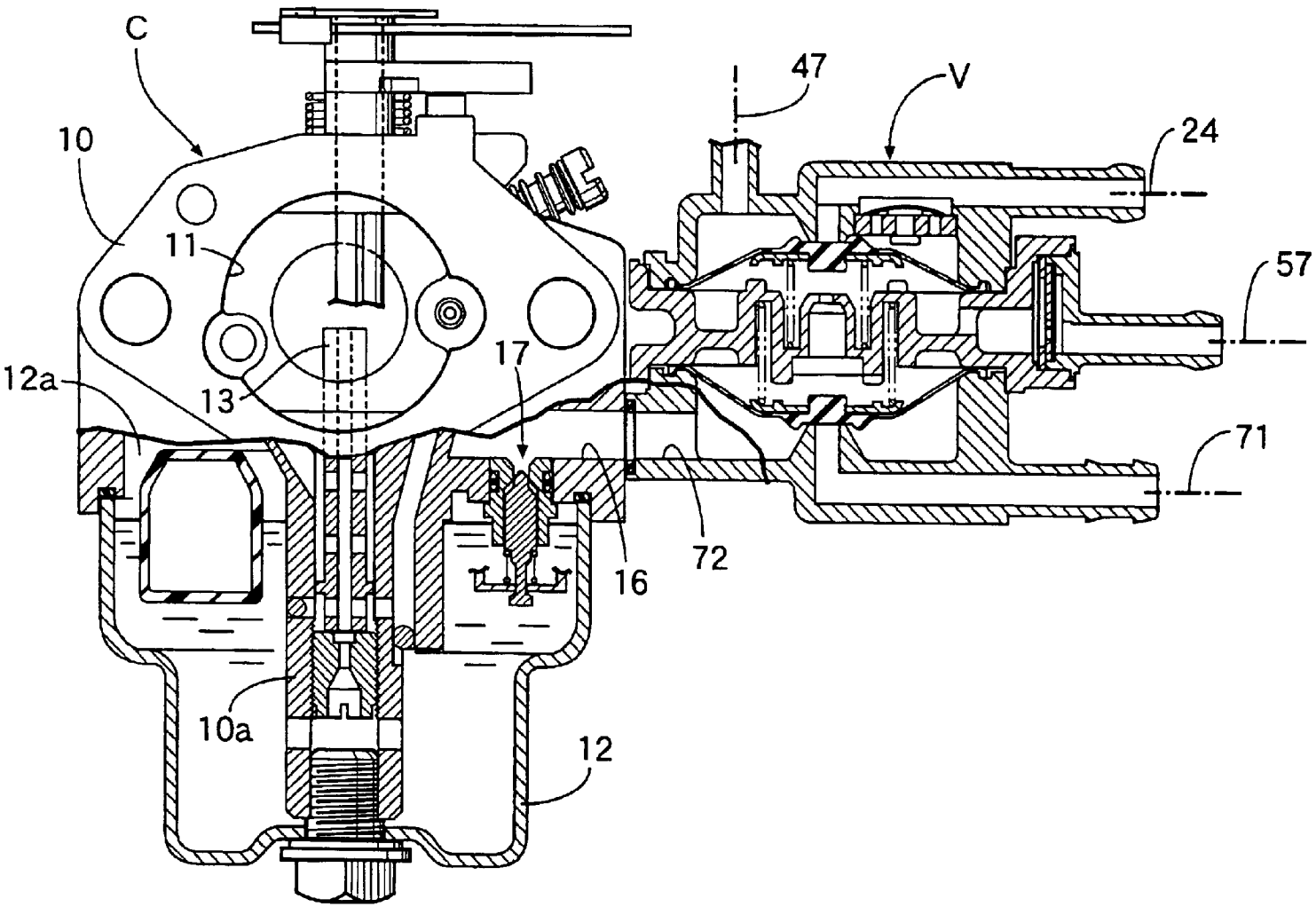
FIG. 3 is a sectional view taken along a line 3—3 in FIG. 2.

Referring to FIG. 3, the carburetor C includes a carburetor body 10 having an intake passage 11 leading to an intake port 6*a* in the cylinder head 6, a float chamber member 12 coupled to a lower surface of the carburetor body 10 and having a float chamber 12*a*, a fuel nozzle 13 which permits an area below a fuel oil surface in the float chamber 12*a* to communicate with a venturi portion of the intake passage 11, a choke valve 14 for opening and closing the intake passage 11 at a location upstream of the intake passage 11, a throttle valve 15 for opening and closing the intake passage 11 at a location downstream of the intake passage 11, and a float valve 17 for opening and closing an fuel inlet 16 of the float chamber member 12 to control the oil surface of a fuel stored in the float chamber 12*a* to be constant. The fuel nozzle 13 is supported in a nozzle support tube 10*a* formed at a lower portion of the carburetor body 10. A composite control valve V is mounted on one side of the float chamber member 12 for controlling the opening and closing of an air vent system for the fuel tank T as well as the opening and closing of a fuel passage system extending from the fuel tank T to the float chamber 12*a* depending on the operational state of the engine E. The composite control valve V will be described later.

Figure 4:
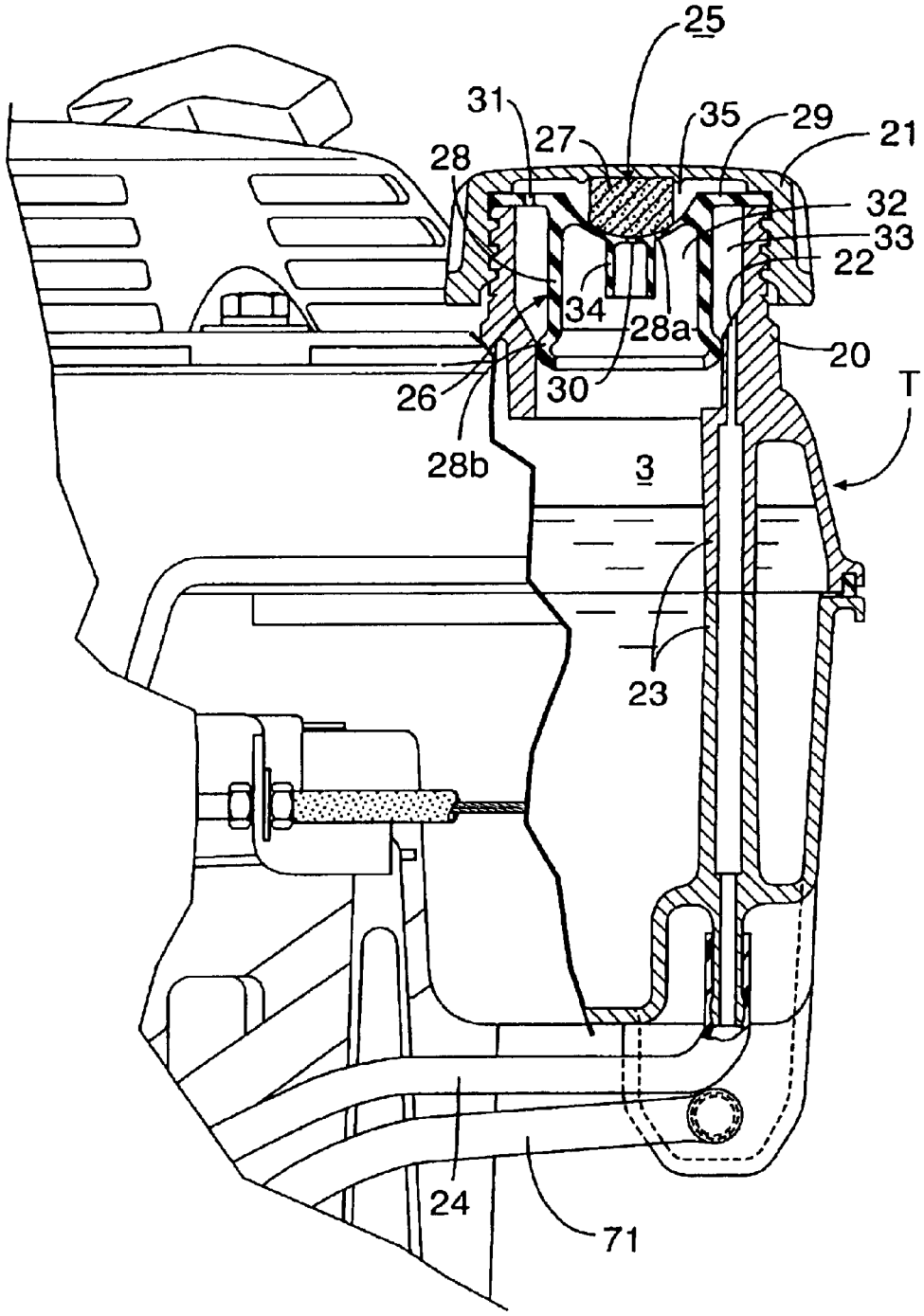
FIG. 4 is an enlarged vertical sectional view of essential portions of the fuel tank.

Referring to FIG. 4, an oil supply port tube 20 formed on one side of a ceiling wall of the fuel tank T is tightly closed by a tank cap 21 threadedly engaged with an outer periphery of the oil supply port tube 20. A ventilation hole 22 opens into an inner surface of the oil supply port tube 20. The ventilation hole 22 extends vertically within the fuel tank T and communicates with an inner air vent pipe 23 extending through a bottom wall of the fuel tank T, and an outer air vent pipe 24 disposed below the fuel tank T is connected at one end to a lower end of the inner air vent pipe 23. The inner air vent pipe 23 is formed integrally with the fuel tank T.

The inner air vent pipe 23 disposed within the fuel tank T is protected from any contact with other objects. It is unnecessary to extend the air vent pipe upward above the fuel tank T and hence, the appearance of the fuel tank T can be maintained to be excellent.

The tank cap 21 is provided with a gas-liquid separating means 25 interposed between an upper space 3 in the fuel tank T and the ventilation hole 22. The gas-liquid separating means 25 is comprised of a partitioning member 26 and a porous member 27 made of a urethane foam having open cells. The partitioning member 26 is made of an elastic material such as rubber, and includes a cylindrical portion 28 disposed within the oil supply port tube 20 and having an upper end wall 28*a* recessed downwards into a cone-shape, a flange portion 29 which protrudes radially outwards from an upper end of the cylindrical portion 28 and which is clamped between an end wall of the tank cap 21 and an end face of the oil supply port tube 20. A seal bead 28*b* is formed at a lower end of the cylindrical portion 28 to come into close contact with an inner peripheral surface of a lower end portion of the oil supply port tube 20. Small bores 30 and 31 are provided in the upper wall 28*a* and the flange portion 29. The partitioning member 26 divides the inside of the oil supply port tube 20 into an inner chamber 32 leading to the upper space 3 within the fuel tank T, an outer chamber 33 which surrounds the inner chamber 32 with the cylinder portion 28 interposed therebetween, and an upper chamber 35 communicating with the inner and outer chambers 32 and 33 through the small bores 30 and 31, respectively. The ventilation hole 22 is disposed to open into the outer chamber 33.

The porous member 27 is set in the upper chamber 35 to cover the small bore 30 in the upper end wall 28*a*. A cylindrical wave trap protruding toward the inner chamber 32, i.e., downwards to surround the small bore 30, is connected to the upper end wall 28*a*.

Thus, the ventilation hole 22 and the upper space 3 within the fuel tank T communicate with each other through the outer chamber 33, the small bore 31, the upper chamber 35, the porous member 27, the small bore 30 and the inner chamber 32, thereby enabling the breathing of the inside of the fuel tank T. On the other hand, even if the fuel in the fuel tank T enters the inner chamber 32 due to waving, the entrance of the fuel into the small bore 30 can be prevented by the wave trap 34. However, when the fuel has entered the upper chamber 35 through the small bore 30, it is absorbed by the porous member 27, and if the fuel absorbing capability of the porous member 27 reaches a level corresponding to a saturated state, the fuel flows toward the small bore 30 along the cone-shaped upper end wall 28*a*, and is dropped into the fuel tank T. In this manner, the fuel in the fuel tank T cannot reach the outer chamber 33 through the outer small bore 31 and hence, the entrance of the fuel into the ventilation hole 22 can be prevented.

The composite control valve V will be described below with reference to FIG. 5.

The composite control valve V has a valve housing 40 which is constructed by sequentially superposing a first block 40*a*, a second block 40*b* and a third block 40*c* one on another and coupling them to one another. In this case, an outer peripheral edge of a first diaphragm 41 is clamped between the first block 40*a* and the second block 40*b*, and an outer peripheral edge of a second diaphragm 42 is clamped between the second block 40*b* and the third block 40*c*. An atmospheric chamber 43 is defined between the first block 40*a* and the first diaphragm 41; a first negative pressure working chamber 44 is defined between the first diaphragm 41 and the second block 40*b*, and a second negative pressure working chamber 43 is defined between the second block 40*b* and the second diaphragm 42. A fuel chamber 46 is defined between the second diaphragm 42 and the third block 40*c*.

An atmospheric air inlet pipe 47 is integrally formed on one sidewall of the first block 40*a* so that the atmospheric chamber 43 is always maintained under an atmospheric pressure. An atmospheric air introducing pipe 49 is integrally formed on the other sidewall of the first block 40*a* to open at its inner end into the atmospheric chamber 43, and the other end of the outer air vent pipe 24 is connected to an outer end of the atmospheric air introducing pipe 49.

An inner end of the atmospheric air introducing pipe 49 is formed at a first valve seat 51 protruding toward the atmospheric chamber 43. A first valve member 52 for opening and closing the atmospheric air introducing pipe 49 by cooperation with the first valve seat 51 is formed at a central portion of the first diaphragm 41. A first return spring 53 for biasing the first valve member toward the first valve seat 51 is mounted under compression between the first diaphragm 41 and the second block 40*b*. A first control valve 50 for opening and closing the atmospheric air introducing pipe 49 is constructed by the first valve member 52 and the first valve seat 51.

A relief valve 54 is mounted on a partition wall between the first block 40*a* and the atmospheric air introducing pipe 49, and adapted to be opened to permit the flowing of air from the atmospheric chamber 43 to the atmospheric air introducing pipe 49, only when the pressure in the fuel tank T is dropped to a level equal to or lower than a predetermined pressure.

A negative pressure introducing pipe 55 communicating with the first negative pressure working chamber 44 is connected to the second block 40*b*, and the negative pressure introducing pipe and a negative pressure pick-up pipe 56 formed on the crankcase of the engine E to lead to a crank chamber 1*a* in the crankcase are connected to each other by a negative pressure conduit 57.

Figure 5:
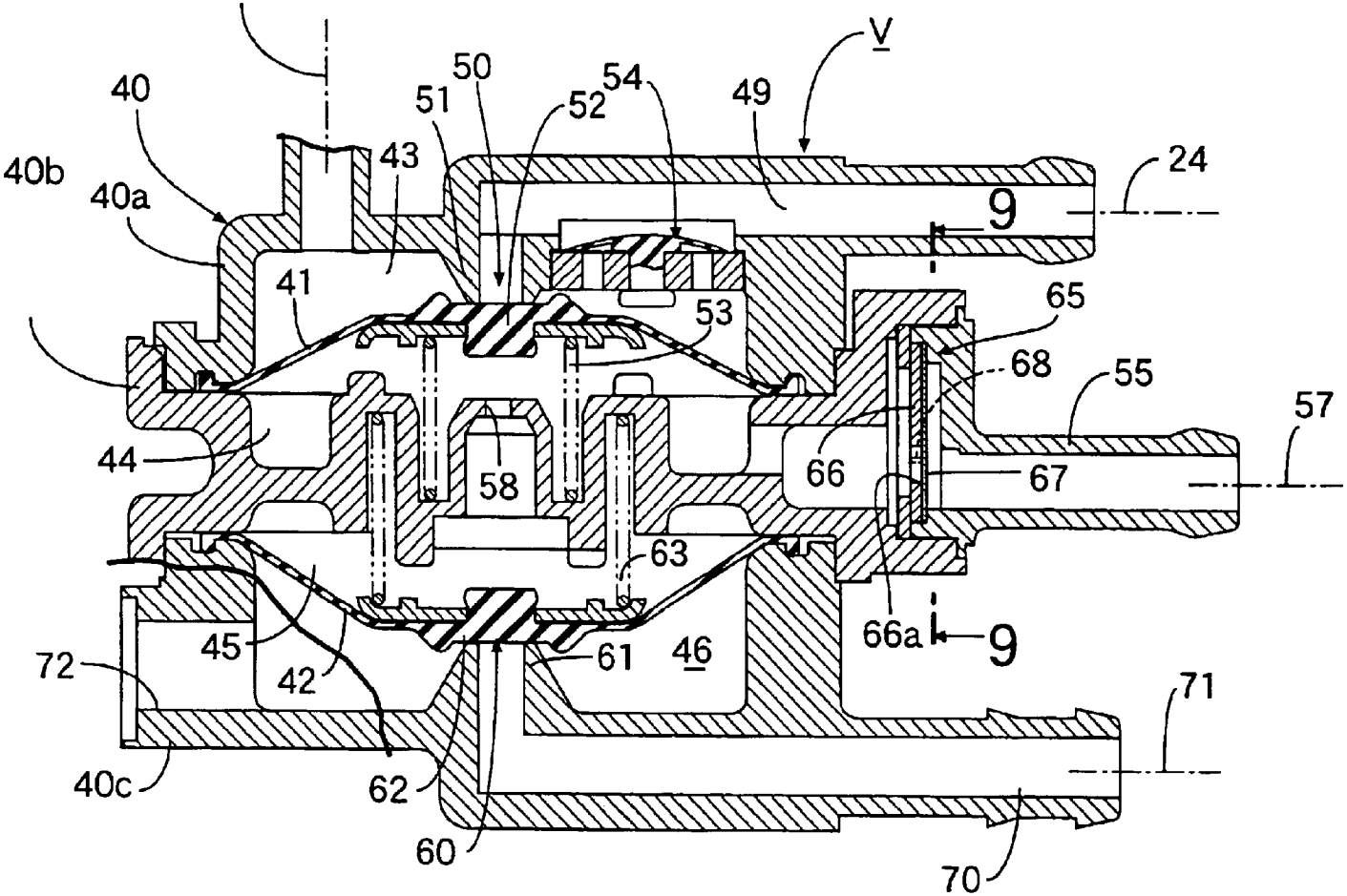
FIG. 5 is an enlarged vertical sectional view of a composite control valve in FIG. 3 (showing an operation-stopped state of the engine)
Figure 9:
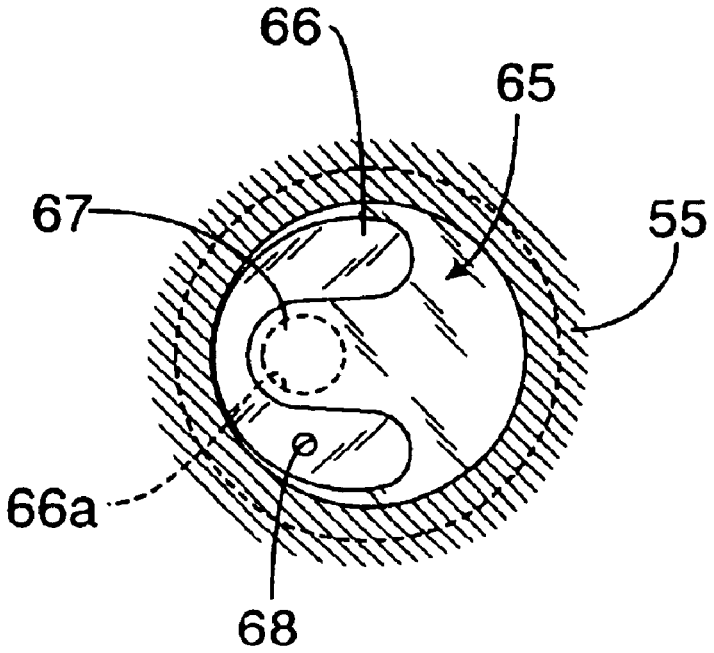
FIG. 9 is a sectional view taken along a line 9—9 in FIG. 5.

As shown in FIGS. 5 and 9, a check valve 65 is mounted at a connection between the second block 40*b* and the negative pressure introducing pipe 55. The check valve 65 includes a valve seat plate 66 and a resilient valve plate 67 clamped between the second block 40*b* and the negative pressure introducing pipe 55. The valve plate 67 is disposed on a side of the valve seat plate 66 closer to the negative pressure introducing pipe 55, to open and close a valve bore 66*a* in the valve seat plate 66 in accordance with a pressure difference across the valve seat plate 66. Therefore, the check valve 65 permits only the transmission of a negative pressure from the negative pressure introducing pipe 55 to the first negative pressure working chamber 44. More specifically, when the pressure in the negative pressure introducing pipe 55 is lower than that in the first negative pressure working chamber 44, the check valve 65 is opened, and when the pressure in the negative pressure introducing pipe 55 is higher that in the first negative pressure working chamber 44, the check valve 65 is closed. A constriction bore 68 is provided in the valve seat plate 66 to permit the negative pressure introducing pipe 55 and the first negative pressure working chamber 44 to be always in communication with each other irrespective of the valve-opening/closing motion of the valve plate 67. The constriction bore 68 may be provided in a portion of the valve plate 67 facing the valve bore 66*a*.

An orifice 58 is provided in the second block 40*b* to permit the communication between the first and second negative pressure working chambers 44 and 45.

A fuel introducing pipe 70 is integrally formed on the third block 40*c*, and a fuel conduit 71 leading to a bottom portion (see FIG. 4) in the fuel tank T is connected to the fuel introducing pipe 70. The third block 40*c* is provided with a fuel outlet 72 which is connected to the fuel inlet 16 in the float chamber member 12.

An inner end of the fuel introducing pipe 70, which opens into the fuel chamber 46, is formed at a second valve seat 61 protruding toward the fuel chamber 46. A second valve member 62 for opening and closing the fuel introducing pipe 70 by cooperation with the second valve seat 61 is formed at a central portion of the second diaphragm 42, and a second return spring 63 is mounted under compression for biasing the second valve member 62 in a direction to seat it on the second valve seat 61. The second return spring has a preset load larger than that of the first return spring 53. A second control valve 60 for opening and closing the fuel introducing pipe 70 is constructed by the second valve member 62 and the second valve seat 61.

The operation of the composite control valve V will be described below.

Upon Stoppage of the Operation of the Engine E (See FIG. 5)

In an operation-stopped state of the engine E, the crank chamber 1*a* is in a state under an atmospheric pressure and hence, the first and second negative pressure chambers 44 and 45 communicating with the crank chamber 1*a* through the constriction bore 68 are also under the atmospheric pressure. As a result, the first and second diaphragms 41 and 42 are biased toward the first and second valve seats 51 and 61 by the preset loads of the first and second return springs 63, 63, respectively, and the first and second valve members 52 and 62 are seated on the first and second valve seats 51 and 61, respectively. Namely, both the first and second control valves 50 and 60 are concurrently closed to block the atmospheric air introducing pipe 49 and the fuel introducing pipe 70, respectively.

On the other hand, if the inside of the fuel tank T is substantially under the atmospheric pressure, the seating of the first valve member 52 onto the first valve seat 51 is not obstructed, and the normally-closed type relief valve 54 is closed to cut off the communication between the atmospheric air introducing pipe 49 and the atmospheric pressure chamber 43.

When the atmospheric air introducing pipe 49 and the fuel introducing pipe 70 is disconnected from each other in this manner, the wasteful downward-flowing of the fuel from the fuel tank T to the carburetor C can be prevented, and the release of the evaporated fuel generated in the fuel tank T to the atmosphere can be prevented.

Figure 6:
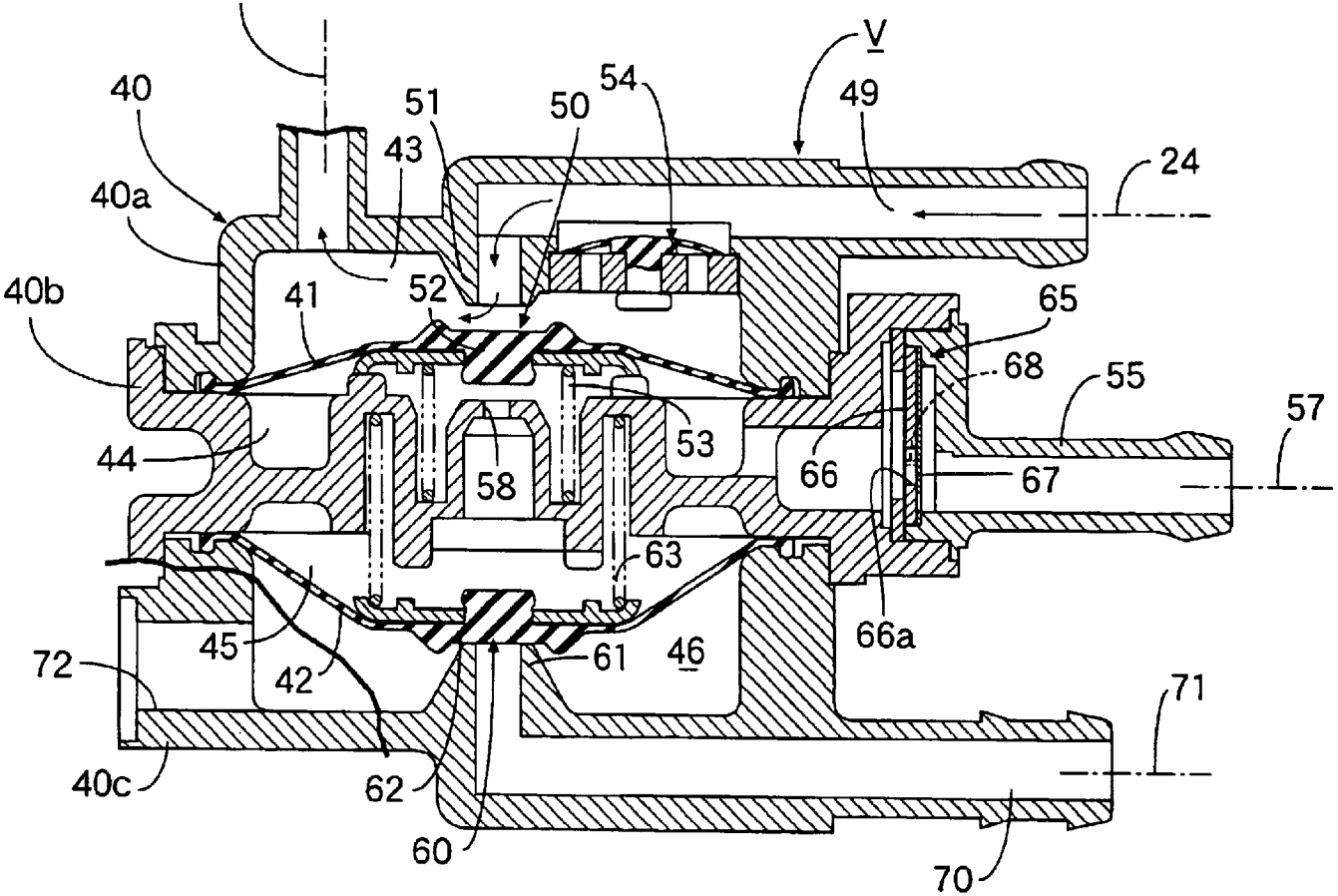
FIG. 6 is a view of the composite control valve for explaining the operation upon increase of a pressure in the fuel tank.

Upon Increase of Pressure in Fuel Tank T (See FIG. 6)

If the fuel tank T is heated by a solar heat or the like when the engine is in the operation-stopped state, as described above, the internal pressure in the fuel tank T is raised to a level equal to or higher than the predetermined pressure, such an internal pressure moves the first valve member 52 away from the first valve seat 51 against the preset load of the first return spring 52, i.e., the first control valve 50 is opened to open the atmospheric air introducing pipe 49 into the atmospheric air chamber 43. Therefore, the excessive increment in pressure in the fuel tank T is released into the atmosphere, and thus the expanding deformation of the fuel tank T due to the excessive raising of the internal pressure can be prevented.

Figure 7:
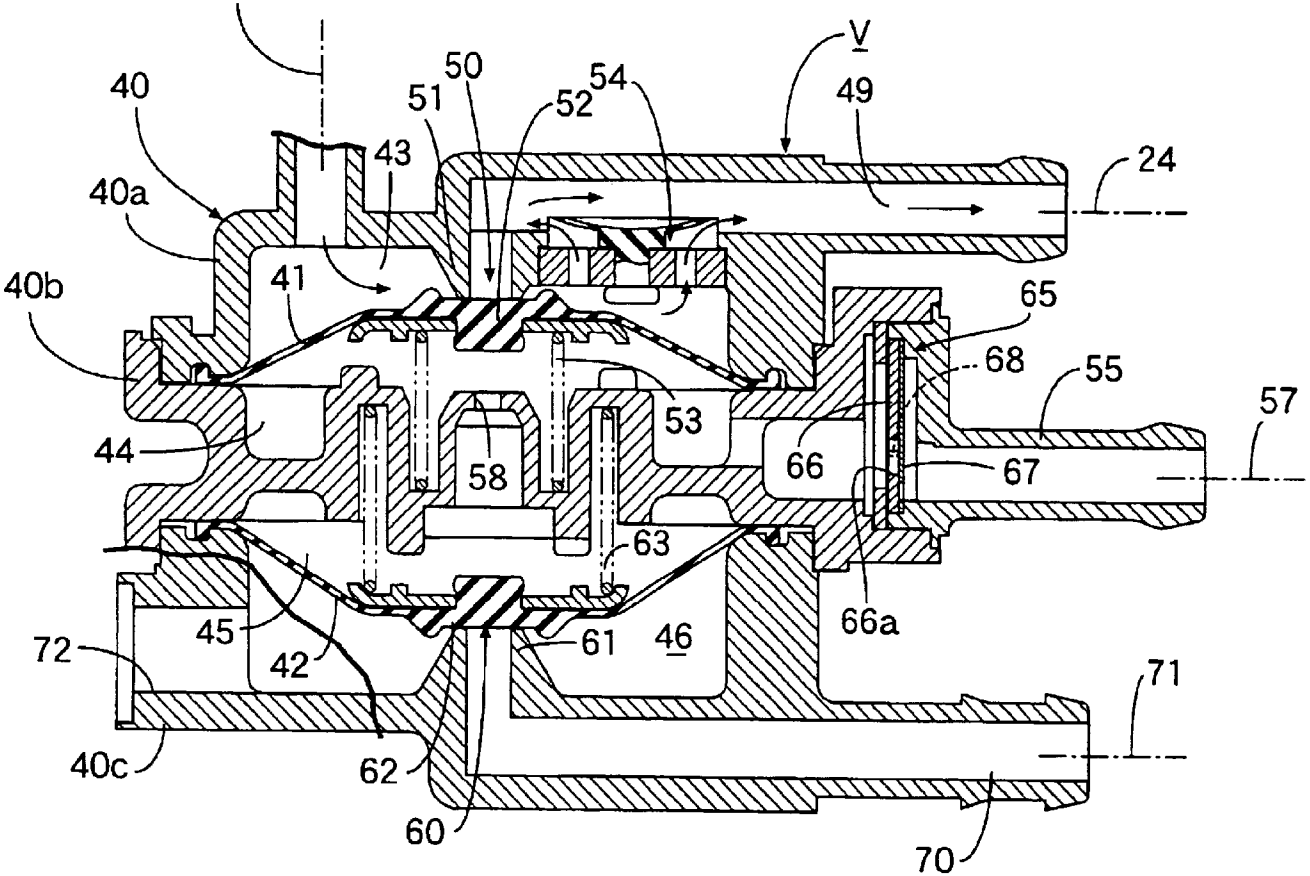
FIG. 7 is a view of the composite control valve for explaining the operation upon decrease of the pressure in the fuel tank.

Upon Decrease of Pressure in Fuel Tank T (See FIG. 7)

When the engine E is in the operation-stopped state, for example, in a cold zone, the fuel tank T is cooled by the outside air, and the pressure in the fuel tank T is reduced to a level equal to or lower than the predetermined value, the relief valve 54 is opened due to a pressure difference across the relief valve 54, to thereby permit the flowing of air from the atmospheric pressure chamber 43 to the atmospheric air introducing pipe 49. Therefore, the atmospheric air is supplemented into the fuel tank T, whereby the constricting deformation of the fuel tank T can be prevented.

Figure 8:
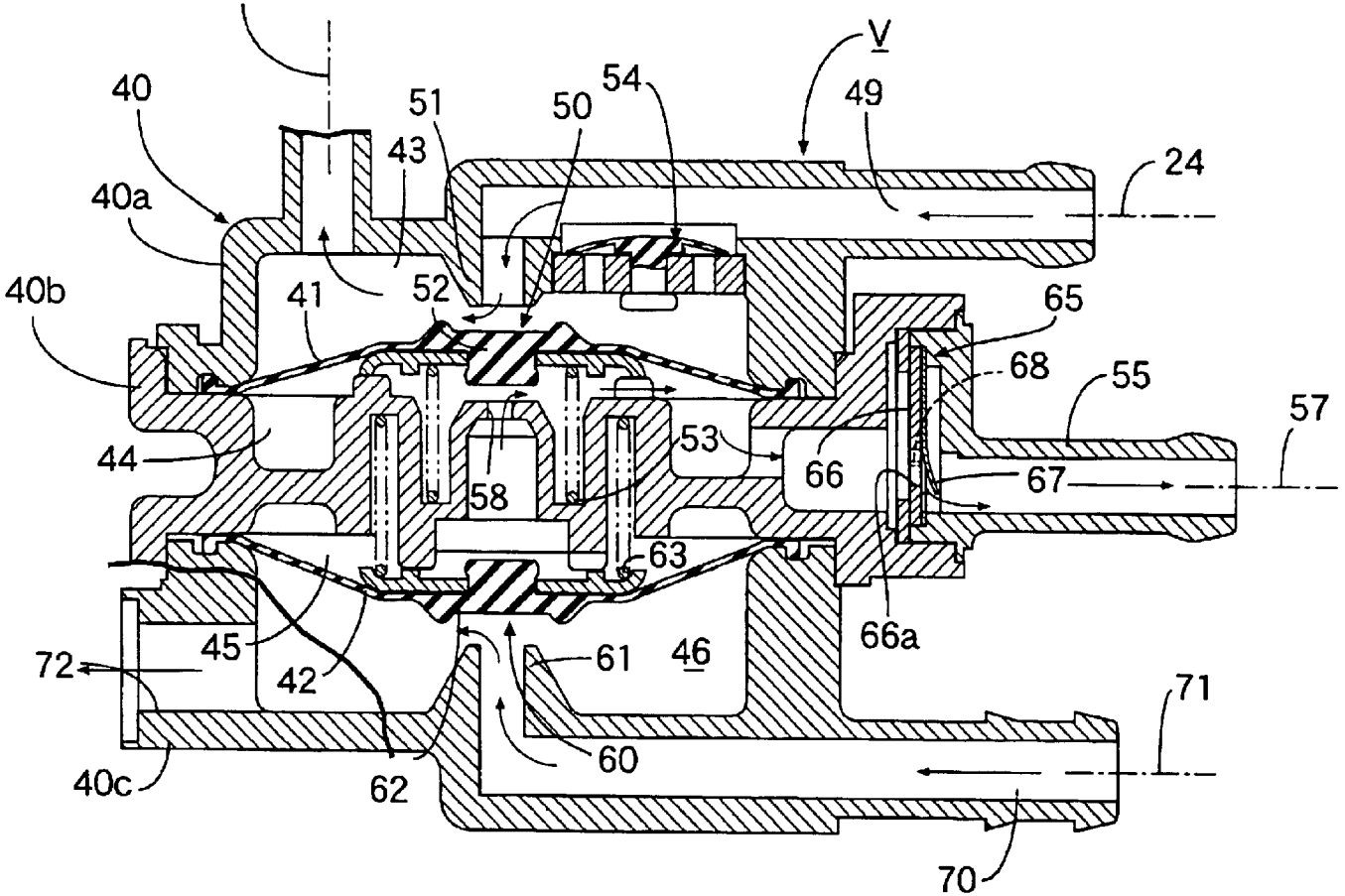
FIG. 8 is a view of the composite control valve for explaining the operation during operation of the engine.

During Operation of the Engine E (See FIG. 8)

During operation of the engine E, the powerful pressure pulsation, in which the positive and negative pressures are alternately generated in the crank chamber 1*a* with the reciprocal movement of a piston, occurs, and is transmitted through the negative pressure conduit 57 and the negative pressure introducing pipe 55 to the check valve 65. The check valve 65 is closed upon the transmission of the positive pressure and opened upon the transmission of the negative pressure. Therefore, eventually, only the negative pressure is passed through the check valve 65 and transmitted first to the first negative pressure working chamber 44 and then through the through-bore 58 to the second negative pressure working chamber 45, whereby the first and second negative pressure working chambers 44 and 45 can be maintained in equally stable high negative pressure states without being influenced by a variation in opening degree of the throttle valve 15 of the carburetor C.

In this case, there is a negative pressure which is leaked from the first and second negative pressure working chambers 44 and 45 through the constriction bore 68 into the crank chamber 1*a*, but the amount of negative pressure leaked is extremely small, as compared with a negative pressure introduced from the crank chamber 1*a* into the first and second negative pressure working chambers 44 and 45, and hence such a negative pressure can be disregarded.

When the first negative pressure working chamber 44 has been brought into a predetermined negative pressure state in this manner, the first diaphragm 41 is pulled toward the first negative pressure working chamber 44 against the preset load of the first return spring 53 to move the first valve member 52 away from the first valve seat 51, i.e., the first control valve 50 is opened to open the atmospheric air introducing pipe 49. Therefore, the upper space 3 in the fuel tank T is brought into a state in which it can freely breathe the external air. When the second negative pressure working chamber 45 has been brought into a predetermined negative pressure state, the second diaphragm 42 is pulled toward the second negative pressure working chamber 45 against the preset load of the second return spring 63 to move the second valve member 62 away from the second valve seat 61, i.e., the second control valve 60 is opened to open the fuel introducing pipe 70. Therefore, the fuel in the fuel tank T is supplied to the float chamber 12*a* in the carburetor C through the fuel conduit 71, the fuel introducing pipe 70 and the fuel chamber 46.

Upon the starting of the engine E, the negative pressure from the crank chamber 1*a* is transmitted first to the first negative pressure working chamber 44, and then from the first negative pressure working chamber 44 through the orifice 58 to the second negative pressure working chamber 45. Also, the preset load of the first return spring 53 is set at the value smaller than that of the second return spring 63. That is, the first diaphragm 41 opens the first control valve 50 to open the atmospheric air introducing pipe 49, and then the second diaphragm 42 opens the second control valve 50 to open the fuel introducing pipe 70. Therefore, the positive or negative pressure remaining in a small amount in the fuel tank T is first released to the atmosphere by the opening of the first control valve 50, and thereafter the supply of the fuel to the carburetor C is started, whereby the excessive supply or insufficient supply of the fuel due to the pressure remaining in the fuel tank T can be prevented to ensure the good startability of the engine E.

In order to control the timing for opening the atmospheric air introducing pipe 49 and the fuel introducing pipe 70 in the above-described manner, the following arrangements are provided in the present embodiment:

(1) The negative pressure introducing pipe 55 is put into communication with the first negative pressure working chamber 44, and the first and second negative pressure working chambers 44 and 45 are put into communication with each other through the orifice 58.

(2) The preset load of the first return spring 53 for biasing the first valve member 52 in a closing direction is set at a value smaller than the preset load of the second return spring 63 for biasing the second valve member 62 in a closing direction.

Both the above arrangements (1) and (2) are employed in the embodiment, but the control of the timing can be achieved by employing any one of these arrangements. When only the arrangement (2) is employed, the first and second negative pressure working chambers 44 and 45 may be formed into a single negative pressure working chamber without being divided.

The composite control valve V for controlling the opening and closing of the air vent system for the fuel tank T and the opening and closing of the fuel supply system extending from the fuel tank T to the carburetor C, as described above, is constructed by the single valve housing 40, and the first and second diaphragms 41 and 42 mounted within the valve housing 40, as well as the first and second control valves 50 and 60. Therefore, the composite control valve V obtains a simple structure and can be provided at a relatively low cost. Moreover, the first and second diaphragms 41 and 42 are disposed to be opposed to each other with the first and second negative pressure working chambers 44 and 45 defined therebetween and hence, the compactness of the composite control valve V can be achieved.

In addition, the check valve 65 is clamped at the fitting connection between the second block 40*b* and the negative pressure introducing pipe 55 and hence, the check valve 65 is also incorporated into the composite control valve V. Thus, it is possible to provide a further simplification with the fuel supply control system for the engine and moreover, the assemblability of the check valve 65 is improved.

Figure 10:
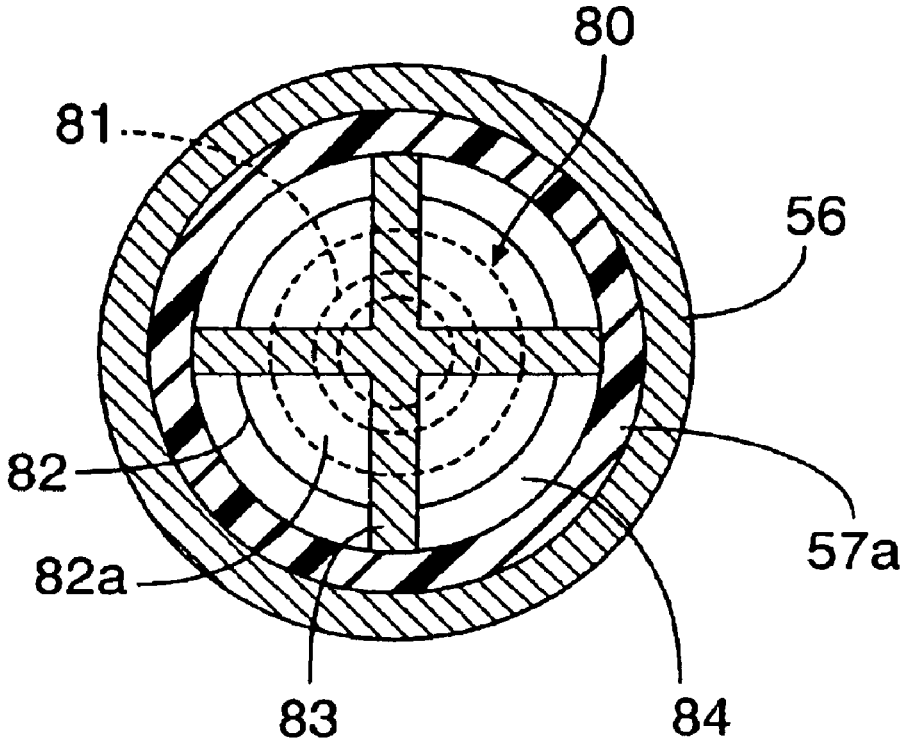
FIG. 10 is a sectional view taken along a line 10—10 in FIG. 2.

Referring to FIGS. 2, 10 and 11, a connecting tube 57*a* is integrally formed at an upstream end of the negative pressure conduit 57 and fitted to an inner peripheral surface of the negative pressure pick-up pipe 56, and the negative pressure pick-up pipe 56 and the connecting tube 57*a* are usually retained at horizontal orientation. The connecting tube 57*a* is provided with an oil flow-out preventing means 80 for preventing a lubricating oil from flowing out of the crank chamber 1*a* to the negative pressure conduit 57 in any attitude of the engine E during transportation or storage of the engine E.

The oil flow-out preventing means 80 is fitted and fixed to the inner peripheral surface of the negative pressure conduit 57 and disposed at a central portion of the connecting tube 57*a*, and includes an inner tube 81 which opens at opposite ends, and an outer tube 82 disposed concentrically between the inner tube 81 and the connecting tube 57*a*. The outer tube 82 has an end wall 82*a* opposed at a distance to a tip end of the inner tube 81. A cross-shaped or radial rib 83 is formed to extend from an outer surface of the end wall 82*a* to an outer peripheral surface of the outer tube 82. The outer tube 82 is retained at a bottom of the connecting tube 57*a* by the engagement of the rib 83 with an inward facing shoulder 87 of an inner periphery of an open end of the connecting tube 57*a*. In addition, an outer ventilation clearance 84 is defined between the connecting tube 57*a* and the outer tube 82 by the abutment of the rib 83 against an inner peripheral surface of the connecting tube 57*a*. An inner ventilation clearance 85 is also defined between the outer tube 82 and the inner tube 81 to communicate with the inner tube 81. Further, a plurality of notches 86 are provided at a tip end of the outer tube 82 to provide communication between the ventilation clearances 84 and 85.

Figure 11A:
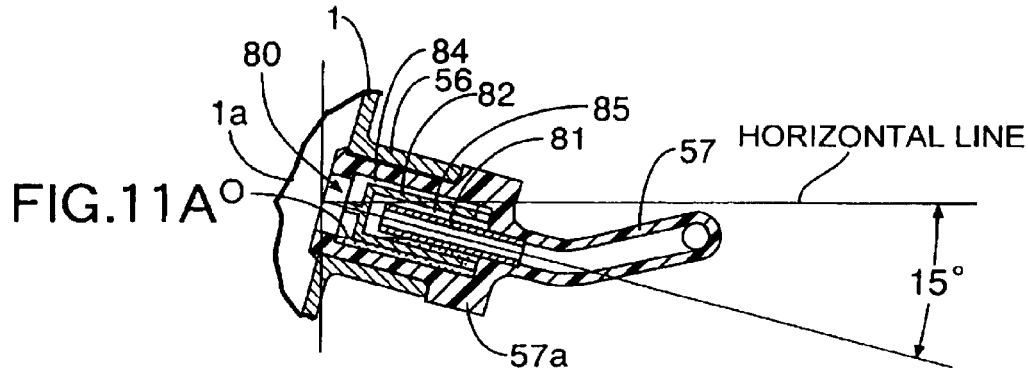
FIGS. 11A, 11B and 11C are views for explaining the operation of an oil flow-out preventing means in FIG. 2.

During operation of the engine E, as shown in FIG. 11A, the negative pressure pick-up pipe 56 is normally retained substantially horizontally, and the crank chamber 1*a* and the negative pressure conduit 57 are in communication with each other through the ventilation clearances 84 and 85 between the outer tube 82 and the inner tube 81 and through the notches 86, thereby enabling the transmission of the pressure pulsation to the negative pressure conduit 57. In this state, even when a small amount of the mist of the lubricating oil O in the crank chamber 1*a* enters and is accumulated in lower portions of the ventilation clearances 84 and 85, the communication between the crank chamber 1*a* and the negative pressure conduit 57 cannot be cut off by the accumulation of the mist.

Figure 11B:
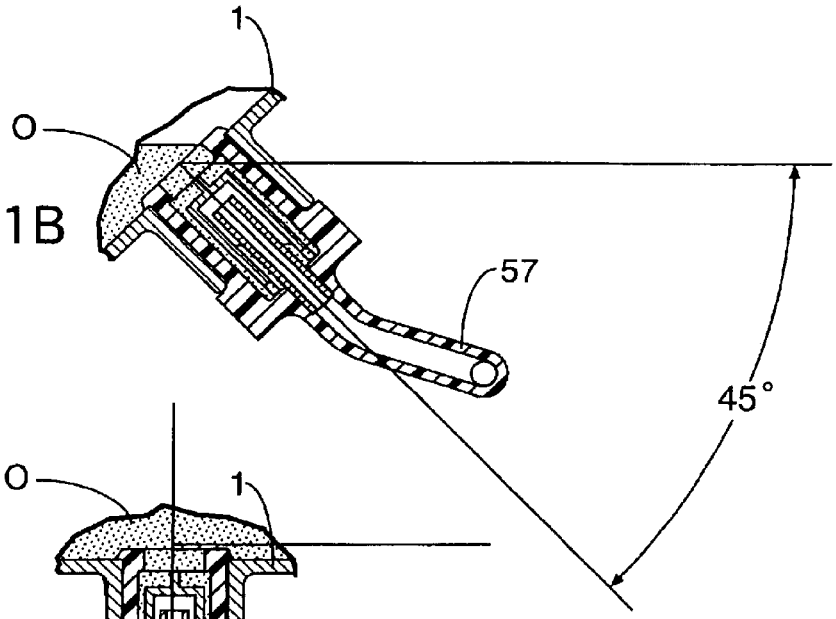
Figure 11C:
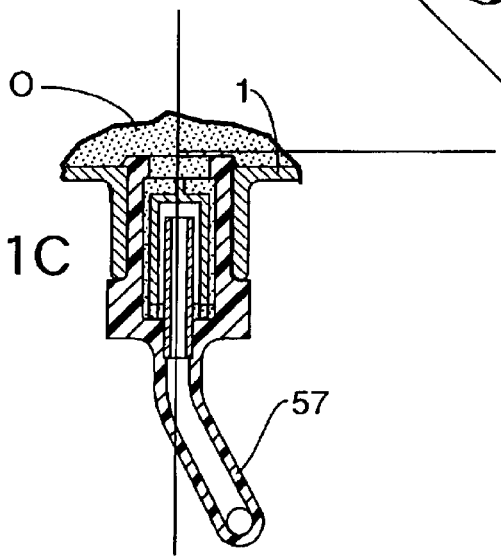

When the engine E is inclined at a given angle or more during transportation or storage of the engine E, the negative pressure pick-up pipe 56 is also inclined or turned upside down, as shown in FIGS. 11B and 11C, whereby the lubricating oil O in the crank chamber 1*a* flows into the connecting tube 57*a* and fills the outer ventilation clearance 84. When the lubricating oil O further fills a lower portion of the inner ventilation clearance 85, the communication between the inner tube 81 and the crank chamber 1*a* is cut off by such oil and moreover, the first and second negative pressure working chambers 44 and 45 with which the inner tube 81 communicates through the negative pressure conduit 57 are tightly-closed chambers isolated from the atmosphere, so that the air is not moved within the negative pressure conduit 57. Therefore, the oil filling the lower portion of the inner ventilation clearance 85 cannot be raised up to an opening at an upper end of the inner tube 81, and thus the flowing-out of the oil to the inner tube 81 and the negative pressure conduit 57 can be prevented.

Moreover, the oil flow-out preventing means 80 including the inner tube 81 and the outer tube 82 has a simple structure, and can be produced at a low cost.

A second embodiment of the present invention shown in FIG. 12 will now be described.

In a carburetor C, a small fuel chamber 75 is defined in a nozzle-supporting tube 10*a* of a carburetor body 10 for supporting a fuel nozzle 13, so that a lower end of the fuel nozzle 13 faces the small fuel chamber 75, and a valve tube 76 interconnecting a float chamber 12*a* and the small fuel chamber 75 is connected to one side of a nozzle support tube 10*a*.

On the other hand, in a valve housing of a composite control valve V, a third block 40 as in the first embodiment is not used, and a second diaphragm 42 is clamped between a second block 40*b* and an outer side of a float chamber member 12 to which the second block 40*b* is coupled. A piston-shaped second valve member 62 is mounted to the second diaphragm 42 and slidably fitted in the valve tube 76. The second valve member 62 has an axial communication groove 77 provided in an outer peripheral surface of a tip end thereof. A second control valve 60 for opening and closing the communication between the float chamber 12*a* and the fuel nozzle 13 is constructed by the second valve member 62 and the valve tube 76.

In the second embodiment, a negative pressure introducing pipe 49 is adapted to communicate equally with the first and second negative pressure working chambers 44 and 45. Therefore, in order to open the first control valve 50 prior to the second control valve 60 at the start of the engine E, as described above, the above-described arrangement (2), i.e., the arrangement in which the preset load of the first return spring 53 is set at the value smaller than the preset load of the second return spring 63, may be employed.

A fuel conduit 71 is connected directly to the fuel inlet 16 adapted to be opened and closed by the float valve 17.

When a negative pressure is introduced into the second negative pressure working chamber 45, whereby the second diaphragm 42 is advanced toward the second negative pressure working chamber 45, the second valve member 62 is also advanced to expose a portion of the communication groove 77 to the float chamber 12*a*, whereby the float chamber 12*a* and the fuel nozzle 13 are brought into communication with each other through the communication groove 77. Therefore, the flowing of the fuel from the float chamber 12*a* into the fuel nozzle 13 is permitted. When the negative pressure is extinguished from the second negative pressure working chamber 45, whereby the second diaphragm 42 is returned toward the float chamber 12*a*, the communication groove 77 in the second valve member 62 returning along with the second diaphragm 42 is withdrawn into the valve tube 76, whereby the communication between the float chamber 12*a* and the fuel nozzle 13 is cut off.

Figure 12:
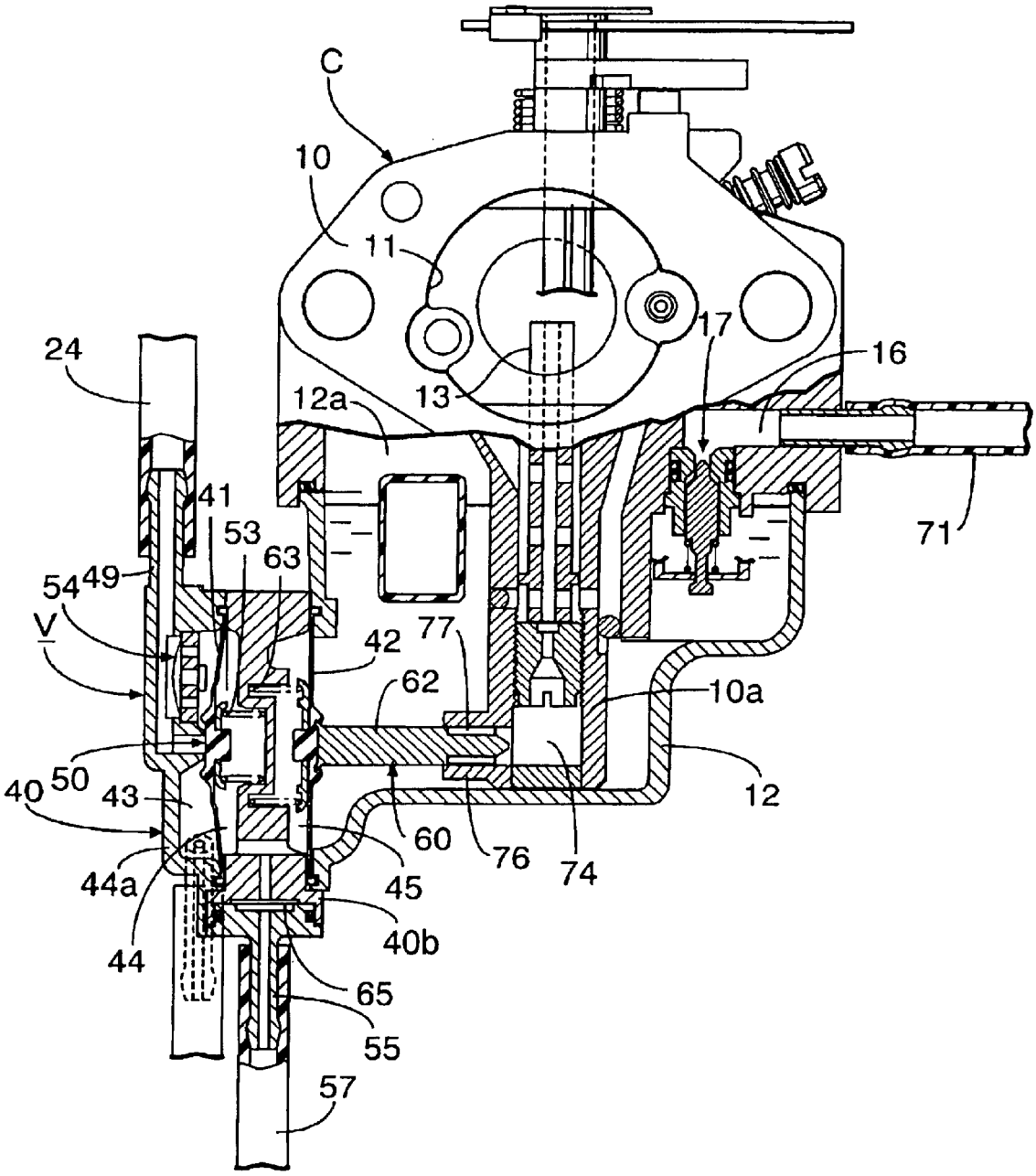
FIG. 12 is a view similar to FIG. 3, but showing a second embodiment of the present invention.

The arrangement of the other components is basically not different from that in the first embodiment and hence, portions or components corresponding to those in the first embodiment are designated by the same reference symbols and numerals in FIG. 12 and the description of them is omitted.

A third embodiment of the present invention shown in FIG. 13 will now be described.

A composite control valve V is mounted to a bottom surface of a float chamber member 12 in a carburetor C. A second valve seat 61 is formed on a lower end face of a nozzle support tube 10*a* of a carburetor body 10, and a second valve member 62 cooperating with the second valve seat 61 is connected to a second diaphragm 42 through a collar 78. A second control valve 60 for opening the closing the communication between a small fuel chamber 75 in a lower portion of the nozzle support tube 10*a* and the float chamber 12*a* is constructed by the second valve member 62 and the second valve seat 61.

A diaphragm 74 clamped between the second valve member 62 and the collar 78 has an outer peripheral portion clamped between the bottom surface of the float chamber member 12 and a third block 40*c* of a valve housing 40, whereby the communication between the float chamber 12*a* and the third block 40*c* is cut off. However, this diaphragm 74 may be disused, whereby the second diaphragm 42 can be exposed to the fuel in the float chamber 12*a*.

Also in the third embodiment, a fuel conduit 71 is connected directly to a fuel inlet 16 adapted to be opened and closed by a float valve 17.

When a negative pressure is introduced into the second negative pressure working chamber 45, whereby the second diaphragm 42 is advanced toward the second negative pressure working chamber 45, the second valve member 62 is also advanced away from the second valve seat 61, whereby the float chamber 12*a* and the fuel nozzle 13 are brought into communication with each other. Therefore, the flowing of the fuel from the float chamber 12*a* into the fuel nozzle 13 is permitted. When the negative pressure from the second negative pressure working chamber 45 is lost, whereby the second diaphragm 42 is returned toward the float chamber 12*a*, the second valve member 62 returning along with the second diaphragm 42 is seated on the second valve seat 61 and hence, the communication between the float chamber 12*a* and the fuel nozzle 13 is cut off.

Figure 13:
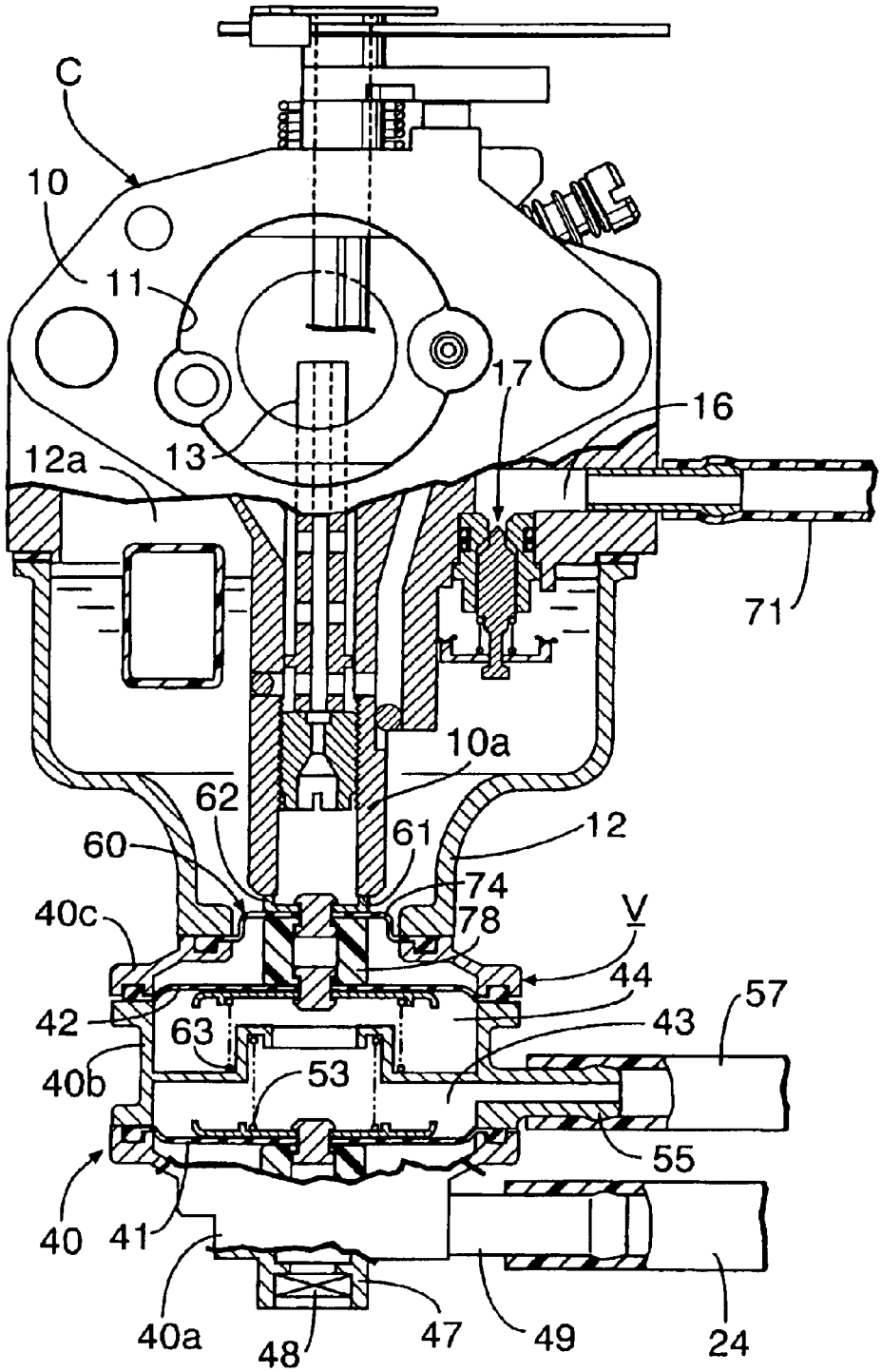
FIG. 13 is a view similar to FIG. 3, but showing a third embodiment of the present invention.

The arrangement of the other components is basically not different from that in the first embodiment and hence, portions or components corresponding to those in the first embodiment are designated by the same reference symbols and numerals in FIG. 13 and the description of them is omitted.

Finally, a fourth embodiment of the present invention shown in FIG. 14 will be described below.

An engine E is constructed into a horizontal type with a crankshaft 2 disposed horizontally. A cylinder block 5 connected to one side of a crankcase 1 supporting the crankshaft 2 is disposed in such a manner that it is inclined at an angle which is nearly horizontal, and a carburetor C is mounted to one side of a cylinder head 6 coupled to the cylinder block 5.

A fuel tank T is mounted on an upper portion of the crankcase 1, and a composite control valve V is mounted to a bottom surface of the fuel tank T. In this composite control valve V, a fuel strainer 79 projectingly mounted on an internal bottom surface of the fuel tank T is connected directly to a fuel introducing pipe 70. An inner air vent pipe 23 extending vertically through the fuel tank T opens at its lower end directly into an atmospheric air introducing recess 49' which corresponds to the atmospheric air introducing pipe 49 in the first embodiment and which is formed in a valve housing 40.

The inner air vent pipe 23 also opens at its upper end into a threadedly engaged portion between a tank cap 21 and an oil supply port tube 20 of the fuel tank T, and the inner air vent pipe 23 communicates with an upper space 3 in the fuel tank T through a spiral clearance existing at such a threadedly engaged portion. The spiral clearance functions as a gas-liquid separating means to inhibit the entrance of a waved fuel in the fuel tank T into the inner air vent pipe 23.

A fuel conduit 71 leading to a fuel chamber 46 in the composite control valve V is connected directly to a fuel inlet in the carburetor C.

Figure 14:
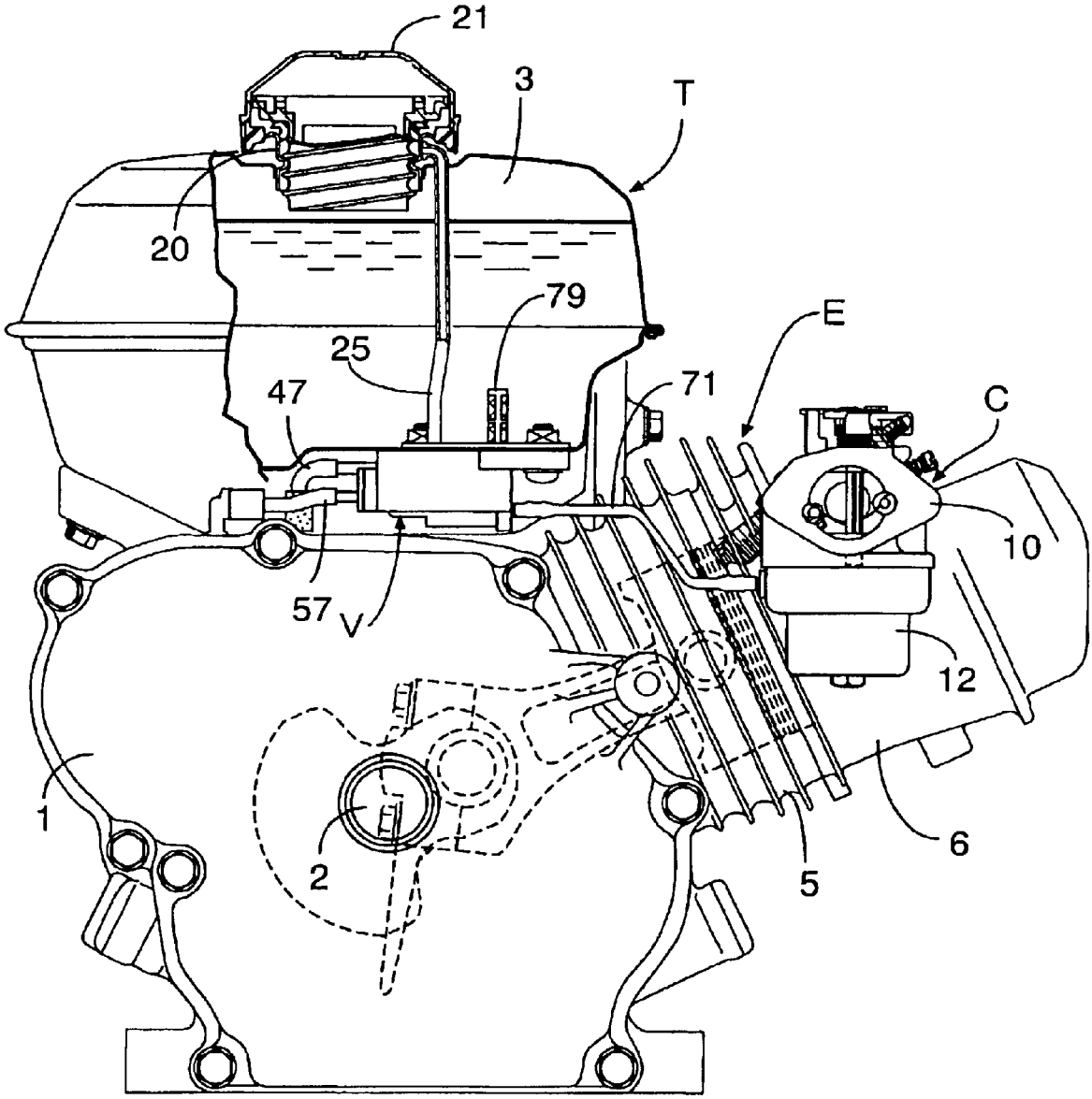
FIG. 14 is a side view of a horizontal-type engine provided with a fuel tank according to a fourth embodiment of the present invention.
Figure 15:
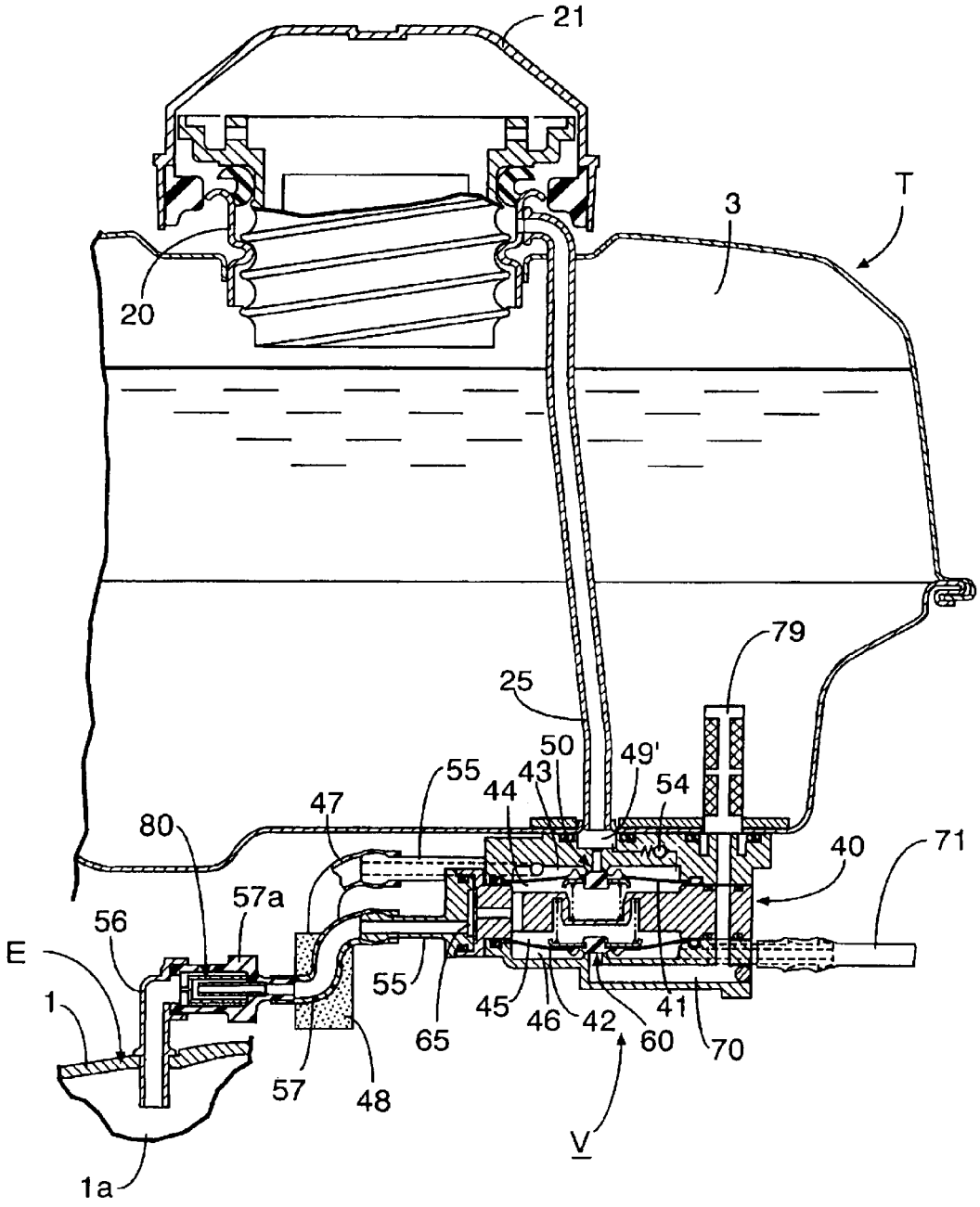
FIG. 15 is an enlarged vertical sectional view of essential portions of FIG. 14.

The arrangement of the other components is similar to that in the first embodiment and hence, portions and components corresponding to those in the first embodiment are designated by the same reference symbols and numerals in FIG. 14 and the description of them is omitted.

The present invention is not limited to the above-described embodiments, and various modifications in design may be made without departing from the subject matter of the invention.

What is claimed is:

1. A fuel supply control system for an engine, comprising a diaphragm attached to a valve housing to define a negative pressure working chamber, a control valve which is connected to the diaphragm and which is operable to be opened and closed by advancing and returning of the diaphragm due to generation and extinction of a negative pressure in the negative pressure working chamber, the control valve being incorporated into a fuel passage system which provides communication between a portion of a fuel tank below a fuel oil surface and a fuel supply section in the engine, the negative pressure working chamber being in communication with a negative pressure generating section in the engine through a negative pressure conduit, wherein an oil flow-out preventing means is provided in a connecting portion for connecting the negative pressure generating section and the negative pressure conduit to each other, the oil flow-out preventing means being adapted to provide communication between the negative pressure generating section and the negative pressure conduit in an operational attitude of the engine, but to cut off the communication between the negative pressure generating section and the negative pressure conduit by a lubricating oil received from the negative pressure generating section, when the engine is inclined at a given angle or more.

2. A fuel supply control system for an engine according to claim 1, wherein the oil flow-out preventing means comprises an inner tube which is disposed at a central portion of the connecting tube for connecting the negative pressure generating section and the negative pressure conduit to each other and which is connected to the negative pressure conduit, and an outer tube which has an end wall covering an opening at a tip end of the inner tube and which is disposed concentrically between the inner tube and the connecting tube; wherein an outer ventilation clearance is defined between opposed peripheral surfaces of the connecting tube and the outer tube to communicate with the negative pressure generating section; wherein an inner ventilation clearance is defined between opposed peripheral surfaces of the outer tube and the inner tube to provide communication between the outer ventilation clearance and the inner tube on a side opposite from the end wall of the outer tube; and wherein the connecting tube, the inner tube and the outer tube are disposed substantially horizontally in the operational attitude of the engine.

* * * * *